US010830484B2

(12) United States Patent
Tsutsumi

(10) Patent No.: US 10,830,484 B2
(45) Date of Patent: Nov. 10, 2020

(54) AIR-CONDITIONING APPARATUS

(71) Applicant: Mitsubishi Electric Corporation, Tokyo (JP)

(72) Inventor: Hiroshi Tsutsumi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 39 days.

(21) Appl. No.: 16/088,533

(22) PCT Filed: May 27, 2016

(86) PCT No.: PCT/JP2016/065769

§ 371 (c)(1),
(2) Date: Sep. 26, 2018

(87) PCT Pub. No.: WO2017/203704

PCT Pub. Date: Nov. 30, 2017

(65) Prior Publication Data

US 2019/0113250 A1 Apr. 18, 2019

(51) Int. Cl.
*F24F 11/89* (2018.01)
*F24F 11/79* (2018.01)
(Continued)

(52) U.S. Cl.
CPC ..... *F24F 11/89* (2018.01); *F24F 1/0007* (2013.01); *F24F 1/0047* (2019.02); *F24F 11/67* (2018.01);
(Continued)

(58) Field of Classification Search
CPC ..... F24F 11/79; F24F 13/08; F24F 13/082; F24F 13/14; F24F 13/06; F24F 2221/14
See application file for complete search history.

(56) References Cited

U.S. PATENT DOCUMENTS

2012/0174608 A1* 7/2012 Kumamoto ..... F24F 1/0011 62/186

FOREIGN PATENT DOCUMENTS

JP S646629 A * 1/1989
JP H01-302059 A 12/1989
(Continued)

OTHER PUBLICATIONS

Noda, Ceiling Embedded Type Air Conditioner, Jan. 11, 1989, JPS646629A, Whole Document (Year: 1989).*
(Continued)

*Primary Examiner* — Larry L Furdge
(74) *Attorney, Agent, or Firm* — Posz Law Group, PLC

(57) ABSTRACT

Provided is a ceiling-concealed air-conditioning apparatus, including: a casing having an opening; a panel, which is provided to the opening and has an air inlet and an air outlet formed on an outer side of the air inlet; a blowing direction flap, which is configured to change a blowing direction of an air blown from the air outlet; a temperature detector, which is configured to detect an intake air temperature of air sucked from the air inlet; and a controller, which is configured to control the blowing direction flap, wherein the controller is configured to, during a heating operation, turn off warm air supply at an intake air temperature higher in a case in which the blowing direction flap is oriented in a horizontal direction relative to a ceiling surface than in a case where the blowing direction flap is oriented in a perpendicular direction relative to the ceiling surface.

17 Claims, 8 Drawing Sheets

(51) Int. Cl.

| | |
|---|---|
| ***F24F 1/0047*** | (2019.01) |
| ***F24F 11/67*** | (2018.01) |
| ***F24F 1/0007*** | (2019.01) |
| ***F24F 13/06*** | (2006.01) |
| ***F24F 13/20*** | (2006.01) |
| ***F24F 13/28*** | (2006.01) |
| *F24F 110/10* | (2018.01) |

(52) U.S. Cl.
CPC ..... *F24F 11/79* (2018.01); *F24F 13/06* (2013.01); *F24F 13/20* (2013.01); *F24F 13/28* (2013.01); *F24F 2110/10* (2018.01); *F24F 2221/14* (2013.01)

(56) References Cited

FOREIGN PATENT DOCUMENTS

JP H07324796 A * 12/1995
JP 2000291993 A * 10/2000
JP 2011069592 A * 4/2011
JP 2015052416 A * 3/2015

OTHER PUBLICATIONS

Nakamura, Wind Path Controlling Device of Air Conditioner, Dec. 12, 1995, JPH07324796A, Whole Document (Year: 1995).*
Hashimoto et al., Control Device, Apr. 7, 2011, JP2011069592A, Whole Document (Year: 2011).*
Imashiro, Operation Controller for Ceiling Cassette Type Air Conditioner, Oct. 20, 2000, JP2000291993A, Whole Document (Year: 2000).*
Itoigawa et al., Air Conditioner, Mar. 19, 2015, JP2015052416A, Whole Document (Year: 2015).*
International Search Report of the International Searching Authority dated Aug. 23, 2016 for the corresponding international application No. PCT/JP2016/065769 (and English translation).

* cited by examiner

| | HORIZONTAL | DOWNWARD 1 | DOWNWARD 2 | DOWNWARD 3 |
|---|---|---|---|---|
| AIRFLOW DIRECTION FLAP CONCEPTUAL VIEW | | | | |
| AIRFLOW DIRECTION | 0° | 30° | 50° | 70° |

FIG. 8

| | HORIZONTAL | DOWNWARD 1 | DOWNWARD 2 | DOWNWARD 3 |
|---|---|---|---|---|
| AIRFLOW DIRECTION FLAP CONCEPTUAL VIEW | | | | |
| SWING PATTERN 1 | (1) | (2) | (3) | (4) |
| | (7) | (6) | (5) | |
| | | (8) | (9) | (10) |
| | (13) | (12) | (11) | |
| | | (14) | (15) | (16) |
| | (19) | (18) | (17) | |
| | | (20) | (21) | (22) |
| | (25) | (24) | (23) | |
| | | (26) | (27) | (28) |
| SWING PATTERN 2 | (1) | (2) | (3) | (4) |
| | (7) | (6) | (5) | |
| | | (8) | (9) | skip |
| | (11) | (10) | | |
| | | (12) | (13) | (14) |
| | (17) | (16) | (15) | |
| | | (18) | (19) | skip |
| | (21) | (20) | | |
| | | (22) | (23) | (24) |
| | (27) | (26) | (25) | |
| SWING PATTERN 3 | (1) | (2) | (3) | (4) |
| | (7) | (6) | (5) | |
| | | (8) | (9) | skip |
| | (11) | (10) | | |
| | | (12) | (13) | skip |
| | (15) | (14) | | |
| | | (16) | (17) | (18) |
| | (21) | (20) | (19) | |
| | | (22) | (23) | skip |
| | (25) | (24) | | |
| | | (26) | (27) | skip |
| SWING PATTERN 4 | (1) | (2) | (3) | skip |
| | (5) | (4) | | |
| | | (6) | (7) | skip |
| | (9) | (8) | | |
| | | (10) | (11) | skip |
| | (13) | (12) | | |
| | | (14) | (15) | skip |
| | (17) | (16) | | |

AIRFLOW DIRECTION DEPENDING ON CEILING HEIGHT (EXAMPLES)

| | HORIZONTAL | DOWNWARD 1 | DOWNWARD 2 | DOWNWARD 3 |
|---|---|---|---|---|
| STANDARD 2.7 m | 0° | 30° | 50° | 70° |
| HIGH CEILING 3.2 m | 0° | 34° | 55° | 73° |
| HIGH CEILING 3.5 m | 0° | 37° | 57° | 74° |

| | SWING TIME: TIME REQUIRED FOR ONE-WAY OPERATION OF CHANGING AIRFLOW DIRECTION FROM "HORIZONTAL" TO "DOWNWARD 3" (EXAMPLE) |
|---|---|
| STANDARD 2.7 m | 10 seconds |
| HIGH CEILING 3.2 m | 13 seconds |
| HIGH CEILING 3.5 m | 14 seconds |

AIR-CONDITIONING APPARATUS

CROSS REFERENCE TO RELATED APPLICATION

This application is a U.S. national stage application of PCT/JP2016/065769 filed on May 27, 2016, the contents of which are incorporated herein by reference.

TECHNICAL FIELD

The present invention relates to blowing direction control of a ceiling-concealed air-conditioning apparatus.

BACKGROUND ART

Hitherto, there has been proposed a ceiling-concealed air-conditioning apparatus with an improved indoor temperature distribution during a heating operation (see, for example, Patent Literature 1). With the ceiling-concealed air-conditioning apparatus disclosed in Patent Literature 1, when indoor air temperature is not stable immediately after start of the heating operation, a blowing direction is set to downward blow, which blows air in a perpendicular direction relative to a ceiling surface. After the indoor air temperature becomes stable, the blowing direction is changed to horizontal blow, which blows air in a horizontal direction relative to the ceiling surface, and an air volume is set to be larger than an air volume given during the downward blow. In this manner, a circulation that flows down a wall surface from the ceiling surface and then flows along a floor surface is generated, thereby improving the indoor temperature distribution during the heating operation.

CITATION LIST

Patent Literature

Patent Literature 1: Japanese Unexamined Patent Application Publication No. Hei 1-302059

SUMMARY OF INVENTION

Technical Problem

The ceiling-concealed air-conditioning apparatus disclosed in Patent Literature 1 has an air outlet on an outer side of an air inlet. Therefore, in the case of the downward blow, a range of air circulation through which air blown from the air outlet is sucked from the air inlet is limited relative to an air-conditioning target room. Therefore, when the downward blow is set as the blowing direction during the heating operation, the temperature distribution tends to be large below the ceiling-concealed air-conditioning apparatus and at positions far from the ceiling-concealed air-conditioning apparatus. Then, after the air below the ceiling-concealed air-conditioning apparatus becomes warm, warm air supply turn-off, which is a control of stopping warm air supply is expected before a whole room becomes warm. As a result, there is a problem in that increase in indoor air temperature of the whole room becomes slow.

The present invention has been made to overcome the problems described above, and has an object to provide a ceiling-concealed air-conditioning apparatus capable of increasing indoor air temperature of a whole room without turning a warm air supply turn-off before the whole room becomes warm during a heating operation even when an air outlet is formed on an outer side of an air inlet.

Solution to Problem

According to one embodiment of the present invention, there is provided a ceiling-concealed air-conditioning apparatus including: a casing having an opening; a panel, which is provided to the opening and has an air inlet and an air outlet formed on an outer side of the air inlet; a blowing direction flap, which is configured to change a blowing direction of an air blown from the air outlet; a temperature detector, which is configured to detect an intake air temperature of air sucked from the air inlet; and a controller, which is configured to control the blowing direction flap, wherein the controller is configured to, during a heating operation, turn off warm air supply at an intake air temperature higher in a case in which the blowing direction flap is oriented in a perpendicular direction relative to a ceiling surface than in a case where the blowing direction flap is oriented in a horizontal direction relative to the ceiling surface

Advantageous Effects of Invention

According to the ceiling-concealed air-conditioning apparatus of one embodiment of the present invention, the intake air temperature at which warm air supply is turned off in the case in which the blowing direction flap is oriented in the perpendicular direction relative to the ceiling surface is higher than the intake air temperature at which warm air supply is turned off in the case in which the blowing direction flap is oriented in the horizontal direction relative to the ceiling surface. This is because the intake air temperature is higher in the case in which the blowing direction is the perpendicular direction relative to the ceiling surface than the intake air temperature in the case in which the blowing direction is the horizontal direction. In this manner, even when the air outlet is formed on the outer side of the air inlet and the intake air temperature increases during the downward blow, the indoor air temperature of the whole room can be increased.

BRIEF DESCRIPTION OF DRAWINGS

FIG. 8 is a table for showing swing patterns of the blowing direction flap of a ceiling-concealed air-conditioning apparatus according to Embodiment 2 of the present invention.

DESCRIPTION OF EMBODIMENTS

Figure 1:
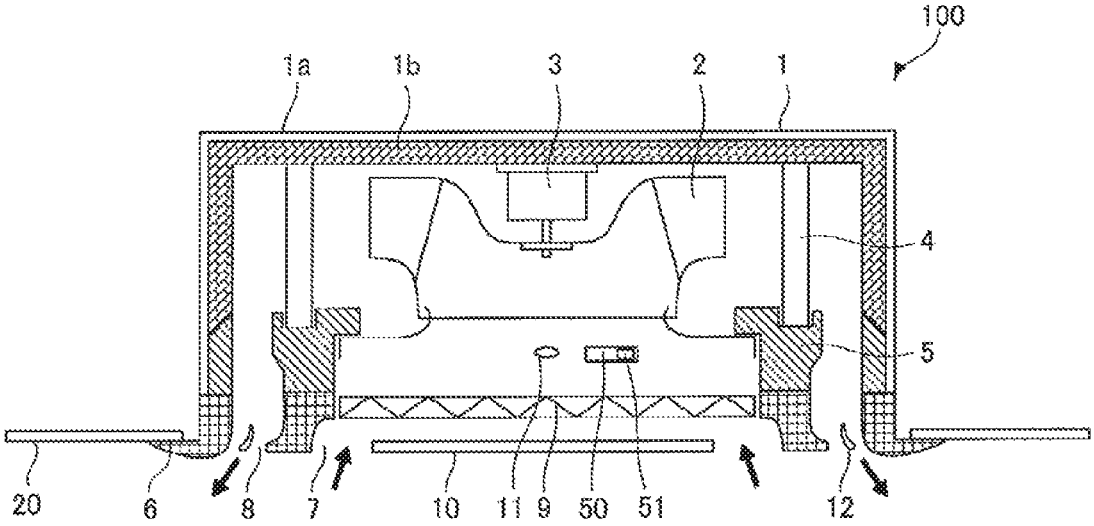
FIG. 1 is a schematic sectional view of a ceiling-concealed air-conditioning apparatus according to Embodiment 1 of the present invention as viewed from a side surface.

Now, embodiments of the ceiling-concealed air-conditioning apparatus of the present invention are described with reference to the drawings. Note that, each embodiment illustrated in the drawings is merely an example, and does not limit the present invention. Further, in the drawings, components denoted by the same reference symbols are the same or corresponding components. This applies throughout the specification. Still further, in the following drawings, the size relationship among the components sometimes differs from the actual relationship.

Embodiment 1

[Configuration of Ceiling-Concealed Air-Conditioning Apparatus 100]

FIG. 1 is a schematic sectional view of a ceiling-concealed air-conditioning apparatus 100 according to Embodiment 1 of the present invention as viewed from a side surface.

Now, description is made of a configuration of the ceiling-concealed air-conditioning apparatus 100 according to Embodiment 1.

As illustrated in FIG. 1, the ceiling-concealed air-conditioning apparatus 100 includes a casing 1. The casing 1 includes an outer shell 1*a* and a heat insulating material 1*b*. The outer shell 1*a* has an opening and is formed of a sheet metal. The heat insulating material 1*b* is provided inside the outer shell 1*a*. Inside the casing 1, there are provided a fan 2, a motor 3, a heat exchanger 4, and a drain pan 5. The fan 2 is arranged to be freely rotatable and is configured to generate flow of air. The motor 3 is coupled to the fan 2 and is driven to rotate. The heat exchanger 4 is arranged to surround the fan 2 and is configured to exchange heat between indoor air sucked into the casing 1 by the fan 2 and refrigerant to generate a conditioning air. The drain pan 5 is arranged below the heat exchanger 4 and is configured to collect drain water from the heat exchanger 4 and form part of an air passage in the vicinity of an air outlet 8.

A panel 6 is provided to the opening of the casing 1. The panel 6 is mounted to a lower side of the ceiling-concealed air-conditioning apparatus 100, and the ceiling-concealed air-conditioning apparatus 100 is installed to a ceiling so that the panel 6 is located on a ceiling surface 20 side. The panel 6 has an air inlet 7 and the air outlet 8. The air inlet 7 is formed in a center, and the indoor air is sucked from the air inlet 7. The air outlet 8 is formed on an outer side of the air inlet 7, and the conditioning air obtained through the heat exchange in the heat exchanger 4 inside the casing 1 is blown from the air outlet 8.

A filter 9 is provided to the air inlet 7. The indoor air, which has been sucked from the air inlet 7 by the fan 2, passes through the filter 9 to be taken into the casing 1. Further, a maintenance panel 10 is provided to the air inlet 7 to cover the filter 9. When the maintenance panel 10 is removed, maintenance on the filter 9, the fan 2, the motor 3, a controller 50, and other components can be carried out.

Blowing direction flaps 12 configured to change a blowing direction within a predetermined range in an up-and-down direction are provided to the air outlet 8. In this case, the up-and-down direction is a direction defined in a state in which the ceiling-concealed air-conditioning apparatus 100 installed to the ceiling is viewed from a side surface as illustrated in FIG. 1. Inside the air inlet 7, a temperature detector 11 configured to detect a temperature of the indoor air sucked from the air inlet 7 as an intake air temperature is provided. The temperature detector 11 is connected to the controller 50 that is provided at a position in proximity to the controller 50.

The controller 50 is constructed of, for example, dedicated hardware or a central processing unit (CPU; also referred to as a processing device, an arithmetic device, a microprocessor, a microcomputer, and a processor) configured to execute a program stored in a memory. Moreover, the controller 50 includes a storage unit 51.

The storage unit 51 is configured to store data required for the controller 50 to perform processing on a temporal or long-term basis, and is constructed of, for example, a memory or other devices.

In Embodiment 1, the controller 50 includes the storage unit 51. However, the storage unit 51 is not required to be provided inside the controller 50. The storage unit 51 may be provided outside the controller 50, and it suffices if the storage unit 51 is electrically connected to the controller 50 to enable mutual communication with the controller 50.

[Operation of Ceiling-Concealed Air-Conditioning Apparatus 100]

Next, description is made of an operation of the ceiling-concealed air-conditioning apparatus 100.

When the motor 3 is driven to rotate, the fan 2 coupled to the motor 3 is rotated. The indoor air is sucked through the air inlet 7, and the indoor air passes through the filter 9 to be sucked into the casing 1. At this time, the intake air temperature is detected by the temperature detector 11. The indoor air sucked by the fan 2 is blown toward the heat exchanger 4 to exchange heat via the heat exchanger 4 to turn into the conditioning air. The conditioning air is blown from the air outlet 8 into an indoor space.

Figure 2:
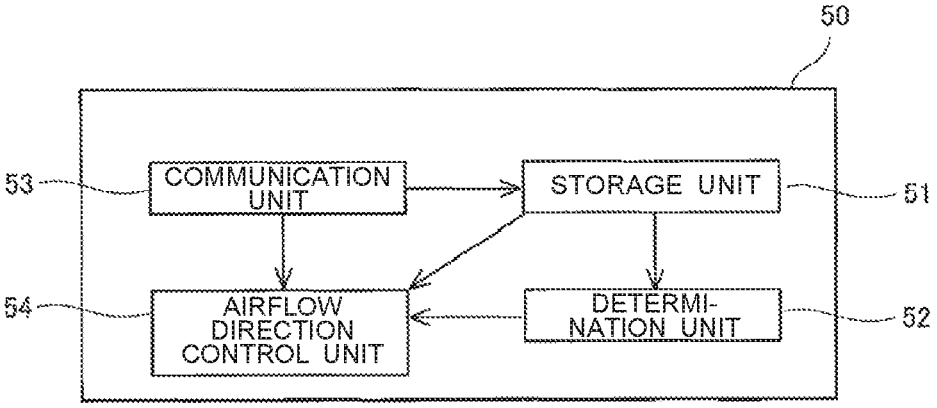
FIG. 2 is a functional block diagram of a controller of the ceiling-concealed air-conditioning apparatus according to Embodiment 1 of the present invention.

FIG. 2 is a functional block diagram of the controller 50 of the ceiling-concealed air-conditioning apparatus 100 according to Embodiment 1 of the present invention.

As illustrated in FIG. 2, the controller 50 includes a communication unit 53, a blowing direction control unit 54, and a determination unit 52, in addition to the storage unit 51. The communication unit 53 is configured to communicate with a remote control (not shown) configured to allow a user to perform operations such as blowing direction setting, temperature setting, and timer setting. The blowing direction control unit 54 is configured to control the blowing direction flaps 12 to control the air flow direction. The determination unit 52 is configured to perform various types of determination such as a warm air supply determination described later.

Figures 3, 4:
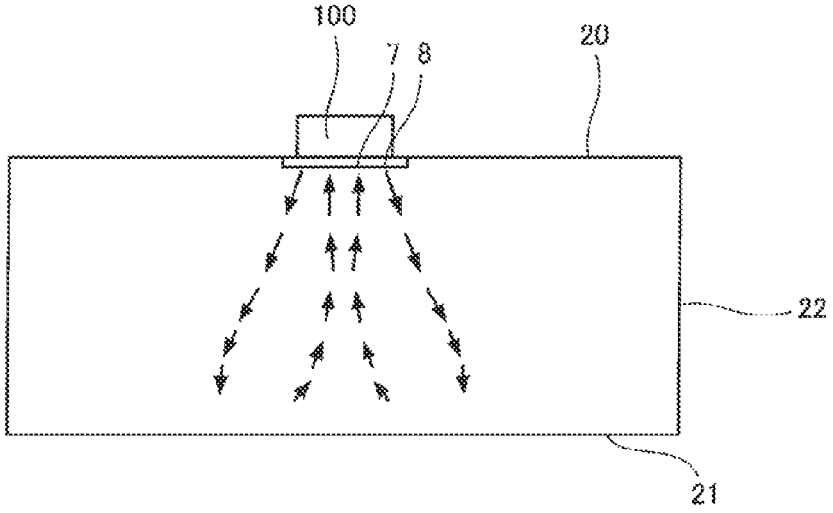
FIG. 3 is a table for showing an orientation of a blowing direction flap with each of blowing direction settings for the ceiling-concealed air-conditioning apparatus according to Embodiment 1 of the present invention.
FIG. 4 is a schematic view for illustrating flow of indoor air when a blowing direction from the ceiling-concealed air-conditioning apparatus according to Embodiment 1 of the present invention is set to "downward 3".

FIG. 3 is a table showing an orientation of the blowing direction flaps 12 with each of blowing direction settings for the ceiling-concealed air-conditioning apparatus 100 according to Embodiment 1 of the present invention. As the blowing direction in FIG. 3, an angle relative to the ceiling surface 20 is shown.

The blowing direction flaps 12 are configured to change the blowing direction in accordance with the setting on the remote control by the user. Blowing direction setting information transmitted from the remote control is received by the communication unit 53 of the controller 50 through communication. The blowing direction control unit 54 of the controller 50 controls a blowing direction flap motor (not shown) connected to the blowing direction flaps 12 to change an orientation of the blowing direction flaps 12 at a predetermined angle. As an example, conceptual views of the blowing direction flap when the blowing directions set by the user are "horizontal", "downward 1", "downward 2", and "downward 3" are shown in FIG. 3. Information relating to the above-mentioned blowing direction settings is stored in the storage unit 51.

Even in the following description, each of the blowing direction settings is described with double quotation marks when denoting the kind of blowing direction setting.

As is understood from FIG. 3, the blowing direction flaps 12 are oriented in a direction closest to a horizontal direction relative to the ceiling surface 20 when the blowing direction is set to "horizontal" and are oriented in a direction closest to a perpendicular direction relative to the ceiling surface 20 when the blowing direction is set to "downward 3". The blowing direction is closest to the horizontal direction relative to the ceiling surface 20 when the blowing direction is set to "horizontal" and is closest to the perpendicular direction relative to the ceiling surface 20 when the blowing direction is set to "downward 3". Therefore, the orientation of the blowing direction flaps 12 and the blowing direction are changed from the horizontal direction closer to the perpendicular direction relative to the ceiling surface 20 in the order of "horizontal", "downward 1", "downward 2", and "downward 3". The blowing direction is determined by the angle of the blowing direction flaps 12 and a shape of the panel. Therefore, an angle of the blowing direction and the angle of the blowing direction flaps 12 are not the same.

The terms "horizontal" and "perpendicular" correspond to a horizontal direction and a perpendicular direction, respectively, relative to the ceiling surface 20 above which the ceiling-concealed air-conditioning apparatus 100 is installed unless otherwise noted. Further, the horizontal direction falls within a range of from 0 degree to 30 degrees relative to the ceiling surface 20, and the perpendicular direction falls within a range of from 60 degrees to 90 degrees relative to the ceiling surface 20.

For the ceiling-concealed air-conditioning apparatus 100, the blowing direction is initially set to "horizontal" during a cooling operation and to "downward 3" during a heating operation. During the cooling operation, a cold air flows downward in natural convection. Thus, the blowing direction is set to "horizontal" with which the air can be conditioned over a relatively wide range. Meanwhile, during the heating operation, a warm air tends to flow upward under an influence of a specific gravity of the air, and it is important to warm up legs and feet for comfortability. Therefore, the blowing direction is set to "downward 3".

It takes long time to start generating a warm air immediately after the start of the heating operation. Therefore, independently of the blowing direction that is appropriately set by a user, the ceiling-concealed air-conditioning apparatus 100 sets the blowing direction to "horizontal" to prevent the user from feeling uncomfortable. Further, the generation of the warm air is temporarily stopped while defrosting control for an outdoor unit is being performed during the heating operation and at the time of warm air supply turn-off after the indoor air temperature reaches a set temperature during the heating operation. Therefore, the ceiling-concealed air-conditioning apparatus 100 sets the blowing direction to "horizontal" to prevent the user from feeling uncomfortable. In this case, the term "warm air supply turn-off" corresponds to stopping supply of warm air supply.

FIG. 4 is a schematic view for illustrating flow of the indoor air when the blowing direction from the ceiling-concealed air-conditioning apparatus 100 according to Embodiment 1 of the present invention is set to "downward 3". The arrows of FIG. 4 indicate flow of air.

Now, description is made of the flow of the indoor air given when the blowing direction is set to "downward 3".

The warm air that is blown downward (for example, at 70 degrees relative to the ceiling surface 20) from the air outlet 8 formed in the vicinity of the ceiling surface 20 flows to reach a floor surface 21 while spreading slightly and then returns to the air inlet 7.

When the blowing direction is set to "downward 3", the amount of warm air that reaches the floor surface 21 is large in the perpendicular direction. Therefore, an air temperature below the ceiling-concealed air-conditioning apparatus 100 increases rapidly. Hence, there is an advantage in that a satisfaction level of the user who is present at a position close to the ceiling-concealed air-conditioning apparatus 100 is high. Meanwhile, in the horizontal direction, a hot-air reaching range is narrow. Therefore, at a position far from the ceiling-concealed air-conditioning apparatus 100, increase in indoor air temperature tends to be slow.

In a course of the flow of air during the heating operation, along with the increase in indoor air temperature, heat of the blown warm air is absorbed by an ambient air. Thus, the warm air returns to the air inlet 7 while the temperature thereof is gradually decreased. Air around the air inlet 7 is also slightly heated by the blown warm air. Therefore, the temperature becomes lowest near the floor surface 21. In a course of returning, the temperature increases again, and the intake air temperature for the ceiling-concealed air-conditioning apparatus 100 tends to become higher than the intake air temperature with the other blowing direction settings.

Figure 5:
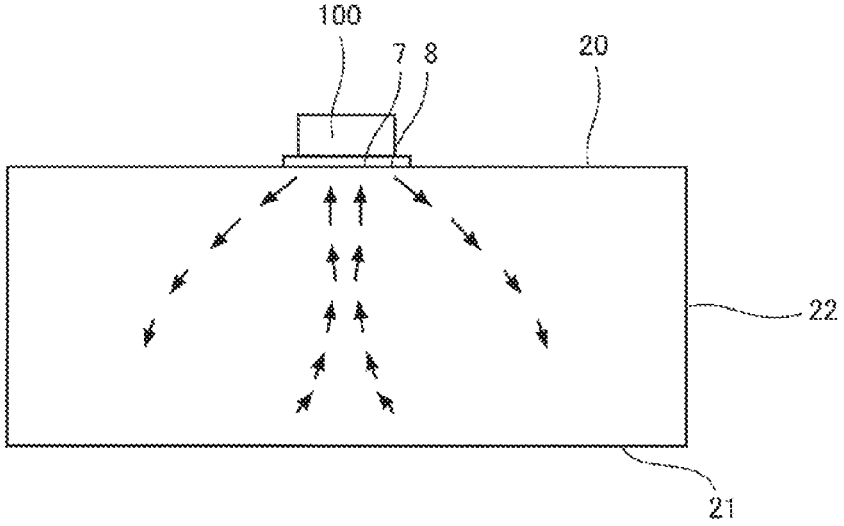
FIG. 5 is a schematic view for illustrating the flow of the indoor air when the blowing direction from the ceiling-concealed air-conditioning apparatus according to Embodiment 1 of the present invention is set to "downward 2".

FIG. 5 is a schematic view for illustrating flow of the indoor air when the blowing direction from the ceiling-concealed air-conditioning apparatus 100 according to Embodiment 1 of the present invention is set to "downward 2". The arrows of FIG. 5 indicate flow of air.

Now, description is made of the flow of the indoor unit given when the blowing direction is set to "downward 2".

The flow of the warm air blown obliquely downward (for example, at 50 degrees relative to the ceiling surface 20) from the air outlet 8 formed in the vicinity of the ceiling surface 20 reaches the floor surface 21 while spreading and then returns to the air inlet 7.

With the blowing direction setting "downward 2", the amount of warm air reaching the floor surface 21 is smaller in the perpendicular direction than the amount of warm air reaching the floor surface 21 with "downward 3". Therefore, increase in air temperature below the ceiling-concealed air-conditioning apparatus 100 tends to be slower than the increase in temperature with "downward 3". Meanwhile, the flow more widely spreads in the horizontal direction than the flow with "downward 3". Therefore, the air can be heated over a wide range.

The air around the air inlet 7 is less heated by the blown warm air than with "downward 3". Therefore, the air temperature returning to the air inlet 7 does not increase by a large amount. Hence, the intake air temperature for the ceiling-concealed air-conditioning apparatus 100 tends to become lower than the intake air temperature with "downward 3".

Figure 6:
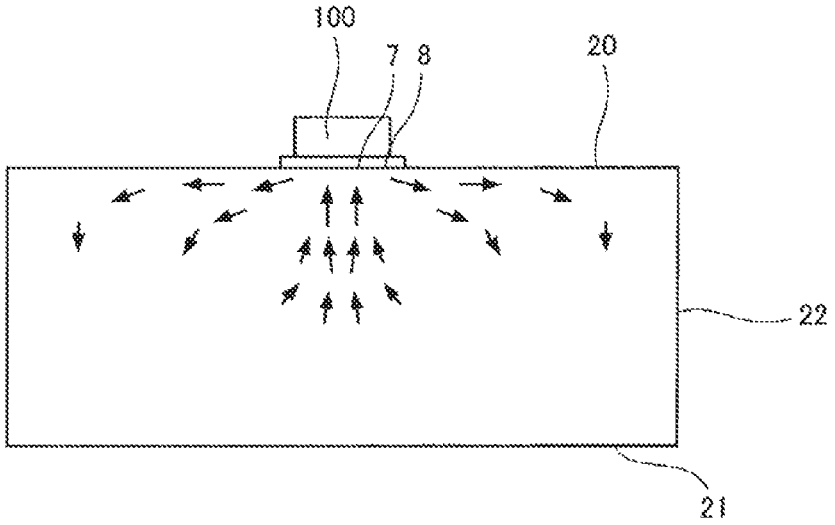
FIG. 6 is a schematic view for illustrating the flow of the indoor air when the blowing direction from the ceiling-concealed air-conditioning apparatus according to Embodiment 1 of the present invention is set to "horizontal".

FIG. 6 is a schematic view for illustrating flow of the indoor air when the blowing direction from the ceiling-concealed air-conditioning apparatus 100 according to Embodiment 1 of the present invention is set to "horizontal". The arrows of FIG. 6 indicate flow of air.

Now, description is made of the flow of the indoor unit when the blowing direction is set to "horizontal".

The warm air blown in the horizontal direction (for example, at 0 degree relative to the ceiling surface 20) from the air outlet 8 in the vicinity of the ceiling surface 20 is influenced by the specific gravity of the air to have a tendency to flow along the ceiling surface 20 to reach wall surfaces 22 and then gradually flow in a direction toward the floor surface 21 along the wall surfaces 22. When the wall surfaces 22 are close, the warm air reaches the floor surface 21 and then flows along the floor surface 21 to return to the air inlet 7. When the wall surfaces 22 are far, the warm air tends to turn back in a layer above the floor surface 21 without reaching the floor surface 21 and return to the air inlet 7.

When the blowing direction is set to "horizontal", the amount warm air reaching the floor surface 21 is smaller in the perpendicular direction than the amount warm air reaching the floor surface 21 during the downward blow. Therefore, increase in air temperature below the ceiling-concealed air-conditioning apparatus 100 tends to be slower than the increase in temperature during the downward blow. Therefore, when the operation is performed with "horizontal" immediately after the start of the heating operation, the satisfaction level of the user who is present at a position close to the ceiling-concealed air-conditioning apparatus 100 becomes low. Meanwhile, the warm air is sent over a wider range than the range over which the warm air is sent during the downward blow. Therefore, for example, in a case in which the wall surfaces 22 are close or in a case in which the ceiling surface 20 is low, a whole room tends to become warm quickly. The intake air for the ceiling-concealed air-conditioning apparatus 100 is less liable to be influenced by the blown air, and therefore has a lower temperature than the temperature of the intake air during the downward blow.

As described above, in the ceiling-concealed air-conditioning apparatus 100, a way of increasing the indoor air temperature differs depending on the blowing direction. Therefore, an "automatic" airflow setting function for changing the blowing direction in accordance with conditions is provided. When the user sets the blowing direction to "automatic" with the remote control, the controller 50 of the ceiling-concealed air-conditioning apparatus 100 controls the blowing direction to achieve a high satisfaction level of the user.

Figure 7A:
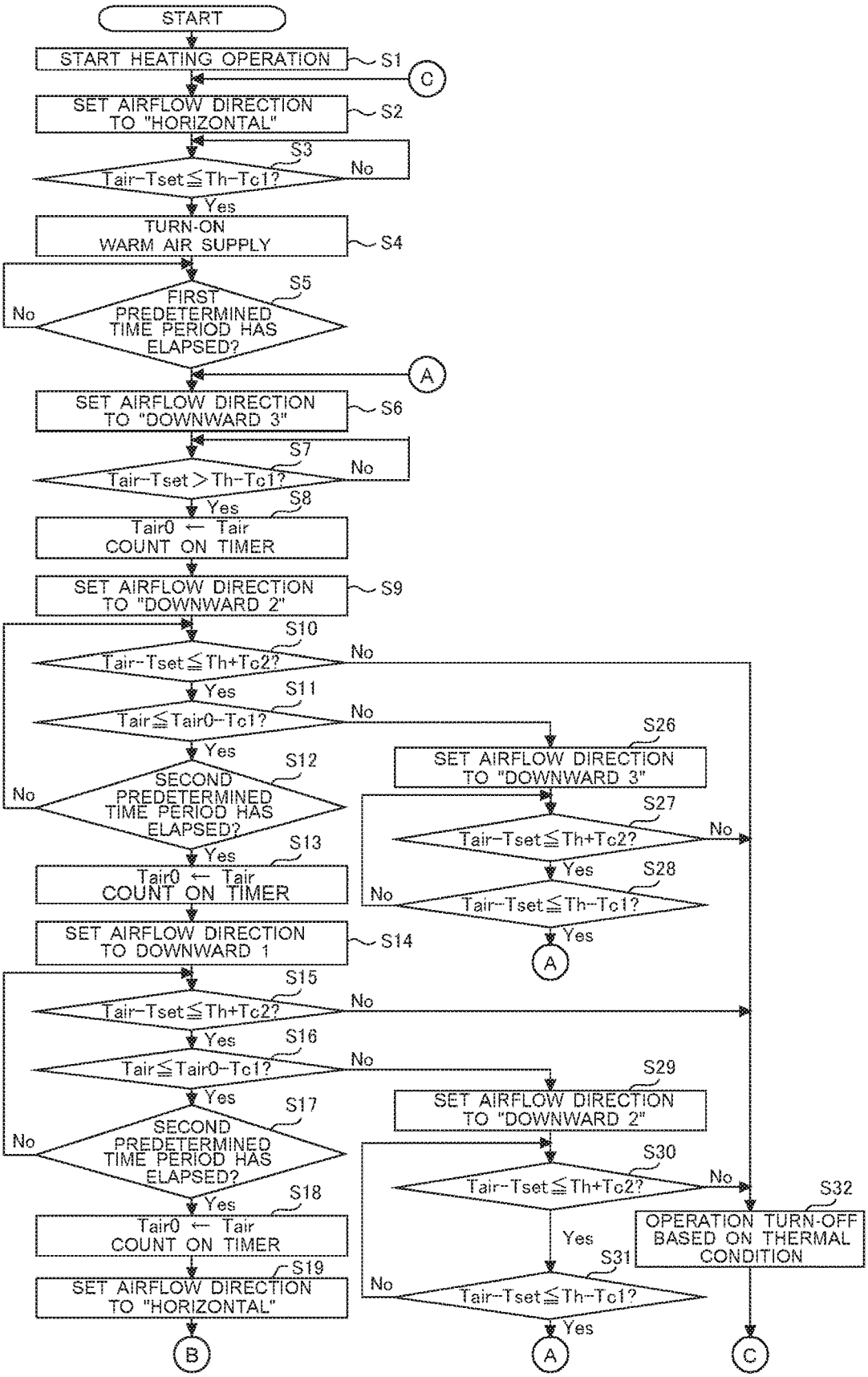
FIG. 7A is a first half of a flowchart for illustrating control that is performed when the blowing direction from the ceiling-concealed air-conditioning apparatus according to Embodiment 1 of the present invention is set to "automatic".
Figure 7B:
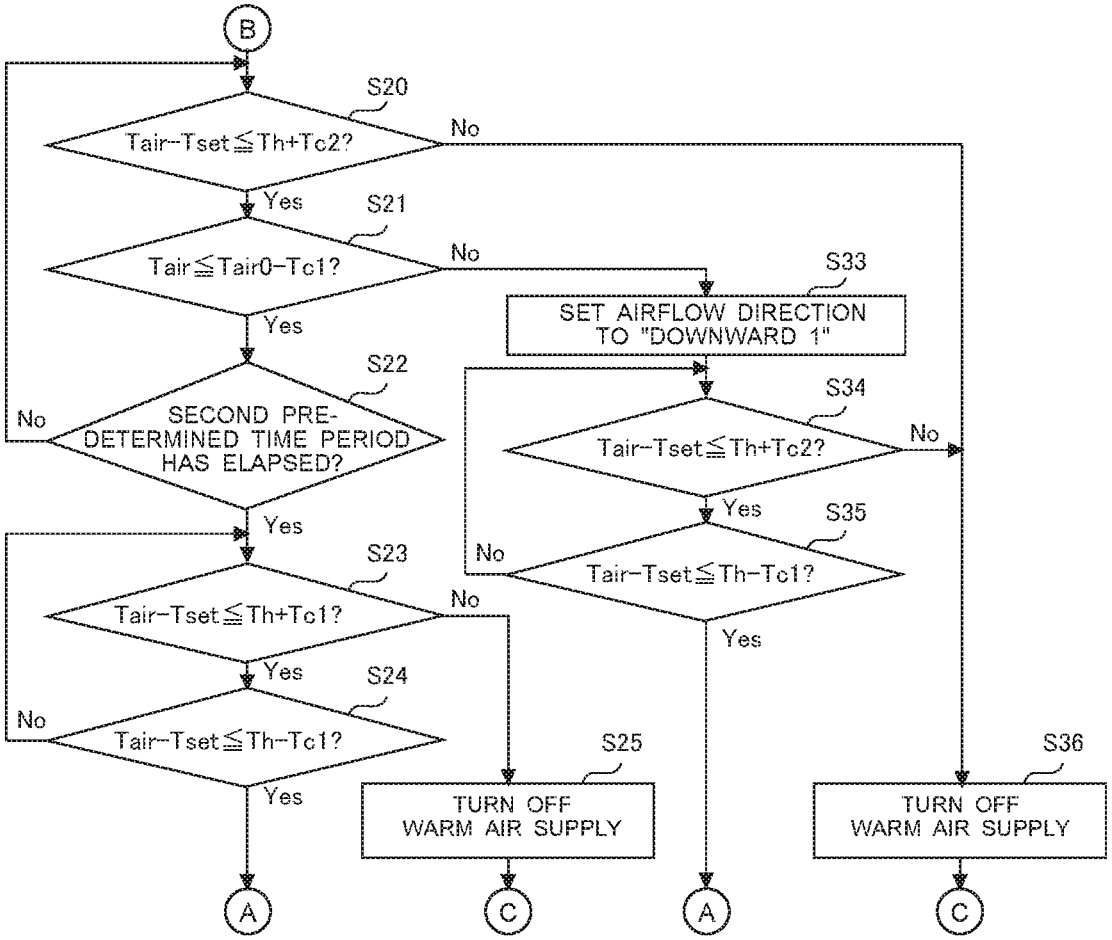
FIG. 7B is a second half of the flowchart for illustrating the control that is performed when the blowing direction from the ceiling-concealed air-conditioning apparatus according to Embodiment 1 of the present invention is set to "automatic".

FIG. 7A is a first half of a flowchart illustrating control that is performed when the blowing direction of the ceiling-concealed air-conditioning apparatus 100 according to Embodiment 1 is set to "automatic", and FIG. 7B is a second half of the flowchart illustrating the control that is performed when the blowing direction of the ceiling-concealed air-conditioning apparatus 100 according to Embodiment 1 is set to "automatic".

Now, with reference to FIG. 7A and FIG. 7B, description is made of the control performed while the ceiling-concealed air-conditioning apparatus 100 according to Embodiment 1 is performing the heating operation.

After start of the heating operation (Step S1), the controller 50 operates the blowing direction flaps 12 to set the blowing direction to "horizontal" (Step S2).

After Step S2, the controller 50 makes a warm air supply determination (Step S3).

The warm air supply determination is made using a temperature difference between an intake air temperature Tair detected by the temperature detector 11 and a set temperature Tset for the indoor air temperature, which is preset by the user through the remote control or other devices. When the air is sucked from the vicinity of the ceiling surface 20 by the ceiling-concealed air-conditioning apparatus 100, the temperature tends to increase as the air becomes closer to the ceiling surface 20 from the floor surface 21 under the influence of the specific gravity of the air. Therefore, a different intake air temperature that is different from the actual temperature is used in consideration of a difference Th between an environment temperature of an environment in which the user is present and the temperature near the air inlet 7 in the vicinity of the ceiling surface 20.

Therefore, the controller 50 determines whether or not to turn on warm air supply based on a result of determination of whether the temperature difference between the intake air temperature Tair and the set temperature Tset is equal to or smaller than a reference temperature Th−Tc1 (Tair−Tset≤Th−Tc1) (Step S3). The above-mentioned value Tc1 is a first temperature correction value and is, for example, 0.5.

In Step S3, when the warm air supply turn-on condition is satisfied (Yes in Step S3), the controller 50 turns on the warm air supply (Step S4) and then determines whether a predetermined time period until the start of blow of the warm air (for example, five minutes or a time period until a refrigerant outlet temperature of the heat exchanger 4 becomes 35 degrees Celsius or higher) has elapsed (Step S5).

In Step S5, when the predetermined time period has elapsed (Yes in Step S5), the controller 50 operates the blowing direction flaps 12 to change the blowing direction from "horizontal" to "downward 3" (Step S6).

After Step S6, the controller 50 determines whether the temperature has increased until the temperature difference between the intake air temperature Tair and the set temperature Tset becomes larger than the reference temperature Th−Tc1 (Tair−Tset>Th−Tc1) to determine whether or not to change the blowing direction (Step S7).

In Step S7, when the condition of changing the blowing direction is satisfied (Yes in Step S7), the controller 50 stores the intake air temperature Tair obtained when the blowing direction is set to "downward 3" in the storage unit 51 and controls a timer to start counting (Step S8). After that, the controller 50 operates the blowing direction flaps 12 to change the blowing direction from "downward 3" to "downward 2" (Step S9).

When a condition of executing the warm air supply turn-off with the blowing direction set to "horizontal" is: Tair−Tset>Th+Tc1, a condition of executing the warm air supply turn-off with the blowing direction being downward, specifically, with the blowing direction set to the direction other than "horizontal" is: Tair−Tset>Th+Tc2, where Tc2>Tc1. Specifically, the temperature condition of executing the warm air supply turn-off in the case in which the blowing direction is downward is set higher than the temperature condition of executing the warm air supply turn-off in the case in which the blowing direction is "horizontal". This is because the intake air temperature becomes higher in the case in which the blowing direction is downward than the intake air temperature in the case in which the blowing direction is "horizontal".

After Step S9, the controller 50 determines whether or not to continue the warm air supply based on whether the temperature difference between the intake air temperature Tair and the set temperature Tset is equal to or smaller than a reference temperature Th+Tc2 (Tair−Tset≤Th+Tc2) (Step S10). The above-mentioned value Tc2 is a second temperature correction value and is, for example, 2.0.

In Step S10, when the warm air supply continuation condition is satisfied (Yes in Step S10), the controller 50 determines whether or not to change the blowing direction based on whether the intake air temperature Tair detected with "downward 2" being currently set has decreased from an intake air temperature Tair0 detected with "downward 3" being currently set, which has been stored in Step S8, by the reference temperature Tc1 or larger (Tair≤Tair0−Tc1) (Step S11).

Meanwhile, when the warm air supply continuation condition is not satisfied, specifically, a warm air supply turn-off condition is satisfied (No in Step S10), the controller 50 executes the warm air supply turn-off (Step S32). Then, the control returns to Step S2.

In Step S11, when the condition of changing the blowing direction is satisfied (Yes in Step S11), the controller 50 determines whether a second predetermined time period (for example, five minutes) has elapsed from the start of counting on the timer in Step S8 (Step S12). When the second predetermined time period has elapsed (Yes in Step S12), the intake air temperature Tair detected when the blowing direction is set to "downward 2" is stored in the storage unit 51 and the timer is controlled to start counting (Step S13). After that, the blowing direction flaps 12 are operated to change the blowing direction from "downward 2" to "downward 1" (Step S14).

Meanwhile, when the condition of changing the blowing direction is not satisfied (No in Step S11), the controller 50 determines that an operation has low efficiency due to, for example, an obstacle that is present in a blowing direction and operates the blowing direction flaps 12 to set the blowing direction back to the previous direction, specifically, change the blowing direction from "downward 2" to "downward 3" (Step S26).

After Step S26, the controller 50 determines whether or not to continue the warm air supply based on whether the temperature difference between the intake air temperature Tair and the set temperature Tset is equal to or smaller than a reference temperature Th+Tc2 (Tair−Tset≤Th+Tc2) (Step S27).

In Step S27, when the warm air supply continuation condition is satisfied (Yes in Step S27), the controller 50 determines whether the temperature difference between the intake air temperature Tair and the set temperature Tset has been decreased to be equal to or smaller than the reference temperature Th−Tc1 based on Tair−Tset≤Th−Tc1 (Step S28).

Meanwhile, when the warm air supply continuation condition is not satisfied, specifically, a warm air supply turn-off condition is satisfied (No in Step S27), the controller 50 executes the warm air supply turn-off (Step S32). Then, the control returns to Step S2.

In Step S28, when the temperature difference between the intake air temperature Tair and the set temperature Tset has been decreased to be equal to or smaller than the reference temperature Th−Tc1 (Yes in Step S28), the control performed by the controller 50 returns to Step S6.

Meanwhile, when the temperature difference between the intake air temperature Tair and the set temperature Tset has not been decreased to be equal to or smaller than the reference temperature Th−Tc1 (No in Step S28), the control performed by the controller 50 returns to Step S27.

After Step S14, the controller 50 determines whether or not to continue the warm air supply based on whether the temperature difference between the intake air temperature Tair and the set temperature Tset is equal to or smaller than a reference temperature Th+Tc2 (Tair−Tset≤Th+Tc2) (Step S15).

In Step S15, when the warm air supply continuation condition is satisfied (Yes in Step S15), the controller 50 determines whether or not to change the blowing direction based on whether the intake air temperature Tair detected with "downward 1" being currently set has decreased from an intake air temperature Tair0 with "downward 2", which has been stored in Step S13, by the reference temperature Tair0−Tc1 or larger (Tair≤Tair0−Tc1) (Step S16).

Meanwhile, when the warm air supply continuation condition is not satisfied, specifically, a warm air supply turn-off condition is satisfied (No in Step S15), the controller 50 executes the warm air supply turn-off (Step S32). Then, the control returns to Step S2.

In Step S16, when the condition of changing the blowing direction is satisfied (Yes in Step S16), the controller 50 determines whether a second predetermined time period has elapsed from the start of counting on the timer in Step S13 (Step S17). When the second predetermined time period has elapsed (Yes in Step S17), the intake air temperature Tair detected when the blowing direction is set to "downward 1" is stored in the storage unit 51 and the timer is controlled to start counting (Step S18). After that, the blowing direction flaps 12 are operated to change the blowing direction from "downward 1" to "horizontal" (Step S19).

Meanwhile, when the condition of changing the blowing direction is not satisfied (No in Step S16), the controller 50 determines that an operation has low efficiency due to, for example, an obstacle that is present in a blowing direction and operates the blowing direction flaps 12 to set the blowing direction back to the previous direction, specifically, change the blowing direction from "downward 1" to "downward 2" (Step S29).

After Step S29, the controller 50 determines whether or not to continue the warm air supply based on whether the temperature difference between the intake air temperature Tair and the set temperature Tset is equal to or smaller than a reference temperature Th+Tc2 (Tair−Tset≤Th+Tc2) (Step S30).

In Step S30, when the warm air supply continuation condition is satisfied (Yes in Step S30), the controller 50 determines whether the temperature difference between the intake air temperature Tair and the set temperature Tset has been decreased to be equal to or smaller than the reference temperature Th−Tc1 based on Tair−Tset≤Th−Tc1 (Step S31).

Meanwhile, when the warm air supply continuation condition is not satisfied, specifically, a warm air supply turn-off condition is satisfied (No in Step S30), the controller 50 executes the warm air supply turn-off (Step S32). Then, the control returns to Step S2.

In Step S31, when the temperature difference between the intake air temperature Tair and the set temperature Tset has been decreased to be equal to or smaller than the reference temperature Th−Tc1 (Yes in Step S31), the control performed by the controller 50 returns to Step S6.

Meanwhile, when the temperature difference between the intake air temperature Tair and the set temperature Tset has not been decreased to be equal to or smaller than the reference temperature Th−Tc1 (No in Step S31), the control performed by the controller 50 returns to Step S30.

After Step S19, the controller 50 determines whether or not to continue the warm air supply based on whether the temperature difference between the intake air temperature Tair and the set temperature Tset is equal to or smaller than a reference temperature Th+Tc2 (Tair−Tset≤Th+Tc2) (Step S20).

In Step S20, when the warm air supply continuation condition is satisfied (Yes in Step S20), the controller 50 determines whether or not to change the blowing direction based on whether the intake air temperature Tair detected with "downward 2" being currently set has decreased from an intake air temperature Tair0 with "downward 3", which has been stored in Step S18, by the reference temperature Tair0−Tc1 or larger (Tair≤Tair0−Tc1) (Step S21).

Meanwhile, when the warm air supply continuation condition is not satisfied, specifically, a warm air supply turn-off condition is satisfied (No in Step S20), the controller 50 executes the warm air supply turn-off (Step S36). Then, the control returns to Step S2.

In Step S21, when the condition of changing the blowing direction is satisfied (Yes in Step S21), the controller 50 determines whether the second predetermined time period has elapsed from the start of counting on the timer in Step S18 (Step S22). When the second predetermined time period has elapsed (Yes in Step S22), it is determined whether or not to continue the warm air supply based on whether the time difference between the intake air temperature Tair and the set temperature Tset is equal to or smaller than a reference temperature Th+Tc1 (Tair−Tset≤Th+Tc1) (Step S23).

Meanwhile, when the condition of changing the blowing direction is not satisfied (No in Step S21), the controller 50 determines that an operation has low efficiency due to, for example, an obstacle that is present in a blowing direction and operates the blowing direction flaps 12 to set the blowing direction back to the previous direction, specifically, change the blowing direction from "horizontal" to "downward 1" (Step S33).

After Step S33, the controller 50 determines whether or not to continue the warm air supply based on whether the temperature difference between the intake air temperature Tair and the set temperature Tset is equal to or smaller than a reference temperature Th+Tc2 (Tair−Tset≤Th+Tc2) (Step S34).

In Step S34, when the warm air supply continuation condition is satisfied (Yes in Step S34), the controller 50 determines whether the temperature difference between the intake air temperature Tair and the set temperature Tset has been decreased to be equal to or smaller than the reference temperature Th−Tc1 based on Tair−Tset≤Th−Tc1 (Step S35).

Meanwhile, when the warm air supply continuation condition is not satisfied, specifically, a warm air supply turn-off condition is satisfied (No in Step S34), the controller 50 executes the warm air supply turn-off (Step S36). Then, the control returns to Step S2.

In Step S35, when the temperature difference between the intake air temperature Tair and the set temperature Tset has been decreased to be equal to or smaller than the reference temperature Th−Tc1 (Yes in Step S35), the control performed by the controller 50 returns to Step S6.

Meanwhile, when the temperature difference between the intake air temperature Tair and the set temperature Tset has not been decreased to be equal to or smaller than the reference temperature Th−Tc1 (No in Step S35), the control performed by the controller 50 returns to Step S34.

In Step S23, when the warm air supply continuation condition is satisfied (Yes in Step S23), the controller 50 determines whether the temperature difference between the intake air temperature Tair and the set temperature Tset has been decreased to be equal to or smaller than the reference temperature Th−Tc1 based on Tair−Tset≤Th−Tc1 (Step S24).

Meanwhile, when the warm air supply continuation condition is not satisfied, specifically, a warm air supply turn-off condition is satisfied (No in Step S23), the controller 50 executes the warm air supply turn-off (Step S25). Then, the control returns to Step S2.

In Step S24, when the temperature difference between the intake air temperature Tair and the set temperature Tset has been decreased to be equal to or smaller than the reference temperature Th−Tc1 (Yes in Step S24, the control performed by the controller 50 returns to Step S6.

Meanwhile, when the temperature difference between the intake air temperature Tair and the set temperature Tset has not been decreased to be equal to or smaller than the reference temperature Th−Tc1 (No in Step S24), the control performed by the controller 50 returns to Step S23.

As described above, the ceiling-concealed air-conditioning apparatus 100 performs heating with the blowing direction set to "downward 3" in an initial time period after the heating operation is started to turn on warm air supply. After the intake air temperature increases to the reference temperature, the blowing direction is changed from "downward 3" to "downward 2", which is closer to the horizontal direction. In this manner, the intake air temperature is decreased. Then, as the intake air temperature is decreased to the reference temperature, the blowing direction is gradually changed to the horizontal direction. As described above, the ceiling-concealed air-conditioning apparatus 100 performs the heating operation while changing the orientation of blowing direction flaps 12 so that the blowing direction is set to decrease the intake air temperature. In this manner, air of a low temperature in the room is sucked. Thus, the operation has high efficiency and is effective in increasing the indoor air temperature of the whole room.

After the intake air temperature is decreased to the reference temperature, the ceiling-concealed air-conditioning apparatus 100 changes the blowing direction back to "downward 3" to perform the operation of heating the air near the floor surface 21. In this case, when the blowing direction is other than "horizontal", the air having a temperature higher than the ambient temperature is sucked. Therefore, the warm air supply turn-off temperature is set higher than the warm air supply turn-off temperature in the case in which the blowing direction is "horizontal" so that the warm air supply is unlikely to be turned off to achieve a continuous operation. In this manner, the temperature of the whole room can be increased.

In FIG. 7A and FIG. 7B, the warm air supply turn-off temperature in the case in which the blowing direction is "horizontal" and the warm air supply turn-off temperature in the case in which the blowing direction is other than "horizontal" are set different. However, the intake air temperature Tair may be set different by a temperature difference between the intake air temperature Tair in the case in which the blowing direction is "horizontal" and the intake air temperature Tair in the case in which the blowing direction is other than "horizontal". For example, when the intake air temperature detected by the temperature detector 11 is Tair, an intake air temperature Tj to be used for the warm air supply determination is equal to Tair in the case in which the blowing direction is "horizontal", and Tj is equal to Tair−1.5 in the case in which the blowing direction is downward.

In this case, for example, the warm air supply continuation condition in Step S10 of FIG. 7A with "downward 2" is: Tj−Tset≤Th+Tc2−1.5. Based on Tc2−1.5=Tc1, the warm air supply continuation condition is equivalent to: Tj−Tset≤Th+Tc1, which is the warm air supply continuation condition in Step S23 of FIG. 7B with "horizontal". This is because the value of Tj differs depending on the difference in blowing direction. When the temperature Tj is used as a temperature to be displayed on the remote control, the temperature Tj changes suddenly depending on the blowing direction. Thus, the temperature Tj may be changed, for example, by Tc1 every thirty seconds to be changed moderately.

When a temperature of the floor surface 21 or at other places is detected by a radiation sensor to calculate a temperature to be used for the warm air supply determination by weighted averaging with the intake air temperature and the temperature detected by the radiation sensor or other methods, the indoor air temperature can be detected with higher accuracy by using the different temperatures for the case in which the blowing direction is "horizontal" and for the case in which the blowing direction is other than "horizontal".

From the description given above, the ceiling-concealed air-conditioning apparatus 100 according to Embodiment 1 includes the casing 1 having the opening, the panel 6, which is provided to the opening and has the air inlet 7 and the air outlet 8 formed on the outer side of the air inlet 7, the blowing direction flaps 12 configured to change the blowing direction of the air blown from the air outlet 8 in the up-and-down direction, the temperature detector 11 configured to detect the intake air temperature of the air sucked from the air inlet, and the controller 50 configured to control the blowing direction flaps 12. During the heating operation, the intake air temperature at which the controller 50 executes the warm air supply turn-off in the case in which the blowing direction flaps 12 are oriented in the perpendicular direction relative to the ceiling surface 20 is higher than the intake air temperature at which the controller 50 executes the warm air supply turn-off in the case in which the blowing direction flaps 12 are oriented in the horizontal direction relative to the ceiling surface 20.

In this manner, even when the air outlet 8 is formed on the outer side of the air inlet 7 and the intake air temperature increases during the downward blow, the indoor air temperature of the whole room can be increased.

Further, in the ceiling-concealed air-conditioning apparatus 100 according to Embodiment 1, during the heating operation, the controller 50 changes the orientation of the blowing direction flaps 12 in accordance with the temperature difference between the intake air temperature and the preset setting temperature.

In this manner, even in the case in which the air outlet 8 is formed on the outer side of the air inlet 7 and the intake air temperature increases during the downward blow, the indoor air temperature of the whole room can be increased.

Further, in the ceiling-concealed air-conditioning apparatus 100 according to Embodiment 1, during the heating operation, the controller 50 changes the orientation of the blowing direction flaps 12 from the perpendicular direction to the horizontal direction relative to the ceiling surface 20 when the temperature difference between the intake air temperature and the set temperature is equal to or smaller than the reference temperature and changes the orientation of the blowing direction flaps 12 from the horizontal direction to the perpendicular direction relative to the ceiling surface 20 when the temperature difference between the intake air temperature and the set temperature is larger than the reference temperature.

As described above, the heating operation is performed while the blowing direction flaps 12 are changed so that the blowing direction is set to decrease the intake air temperature. As a result, the air of low temperature of the room is sucked. Thus, the operation has high efficiency and is effective in increasing the indoor air temperature of the whole room. Further, it is determined that the operation is performed with low efficiency due to, for example, an obstacle that is present in the blowing direction. Through the change in orientation of the blowing direction flaps 12 from the horizontal direction to the perpendicular direction relative to the ceiling surface 20, the efficiency of the operation can be prevented from being lowered.

Embodiment 2

Now, description is made of a ceiling-concealed air-conditioning apparatus 100A according to Embodiment 2 of the present invention. A configuration of the ceiling-concealed air-conditioning apparatus 100A is the same as the ceiling-concealed air-conditioning apparatus 100 according to Embodiment 1, and the description thereof is herein omitted.

Embodiment 2 differs from Embodiment 1 only in the blowing direction control, and therefore only the blowing direction control is described.

The ceiling-concealed air-conditioning apparatus 100A according to Embodiment 2 has a function of swinging the blowing direction flaps 12. The term "swing" corresponds to a constant reciprocating operation of the blowing direction flaps 12 from the horizontal direction to the perpendicular direction and from the perpendicular direction to the horizontal direction, specifically, repeatedly changing the blowing direction from "horizontal" to "downward 3" and from "downward 3" to "horizontal" without fixing the blowing direction. As a result, the flow of the air illustrated in FIG. 4 to FIG. 6 is repeated.

Therefore, heating for the floor surface 21 when the blowing direction is "downward 3" and heating over a wide range when the blowing direction is "downward 2" are enabled. The blowing direction flaps 12 perform the reciprocating operation with "swing", and the air around the air inlet 7 is heated slightly with the blown warm air when the blowing direction is "downward 3". Therefore, the intake air temperature tends to increase. Specifically, with "swing", the intake air temperature becomes higher than the intake air temperature in the case in which the blowing direction is "horizontal". Therefore, with "swing", the temperature condition of executing the warm air supply turn-off is set higher than the temperature condition in the case in which the blowing direction is "horizontal".

Further, in order to suck air of the low temperature of the room to enhance the efficiency of the operation to promote the increase in indoor air temperature of the whole room, the control skips the angle with "downward 3" in accordance with the difference between the intake air temperature and the set temperature with "swing".

FIG. 8 is a table for showing swing patterns of the blowing direction flaps 12 of the ceiling-concealed air-conditioning apparatus 100A according to Embodiment 2 of the present invention. The numerical values in FIG. 8 denote the order of the operation of the blowing direction flaps 12.

As shown in FIG. 8, when the intake air temperature is sufficiently lower than the set temperature as at the start of heating, a swing pattern 1 without skipping "downward 3" or a swing pattern 2 with "downward 3" skipped once for two reciprocations is selected. After increase in indoor air temperature starts, a swing pattern 3 with "downward 3" skipped twice for three reciprocations and a swing pattern 4 with "downward 3" skipped for all the reciprocations is selected.

Figure 9:
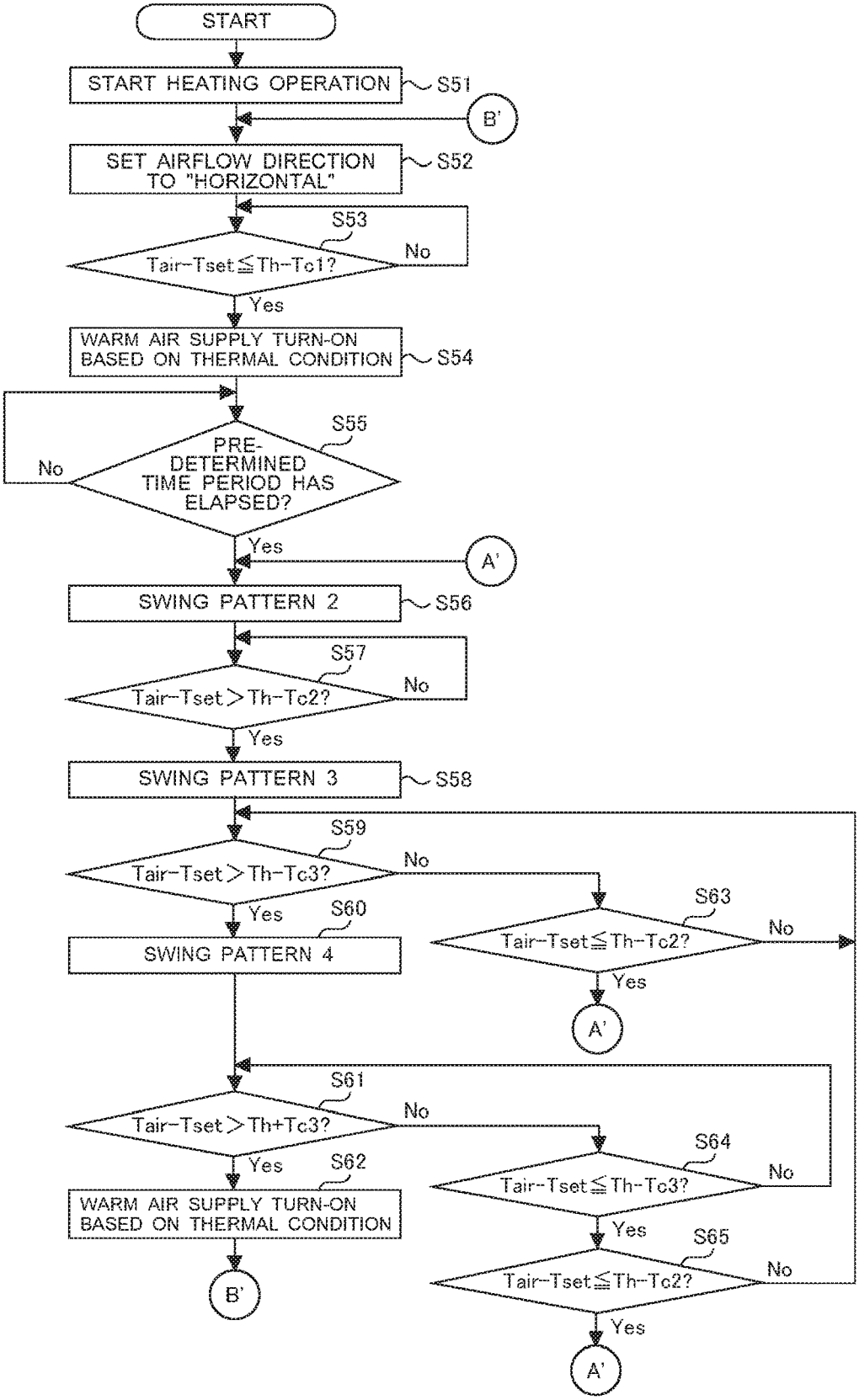
FIG. 9 is a flowchart of control that is performed when the blowing direction from the ceiling-concealed air-conditioning apparatus according to Embodiment 2 of the present invention is set to "swing".

FIG. 9 is a flowchart for illustrating control that is performed when the blowing direction from the ceiling-concealed air-conditioning apparatus 100A according to Embodiment 2 of the present invention is set to "swing".

Now, with reference to FIG. 9, description is made of the control performed while the ceiling-concealed air-conditioning apparatus 100A according to Embodiment 2 is performing the heating operation.

After start of the heating operation (Step S51), the controller 50 operates the blowing direction flaps 12 to set the blowing direction to "horizontal" (Step S52).

After Step S2, the controller 50 makes a warm air supply determination (Step S53).

The warm air supply determination is made using a temperature difference between an intake air temperature Tair detected by the temperature detector 11 and a set temperature Tset for the indoor air temperature, which is preset by the user through the remote control or other devices. When the air is sucked from the vicinity of the ceiling surface 20 by the ceiling-concealed air-conditioning apparatus 100, the temperature tends to increase as the air becomes closer to the ceiling surface 20 from the floor surface 21 under the influence of the specific gravity of the air. Therefore, a different intake air temperature is used in consideration of a difference Th between an environment temperature in which the user is present and the temperature near the air inlet 7 in the vicinity of the ceiling surface 20.

Therefore, the controller 50 determines whether or not to turn on warm air supply based on a result of determination of whether the temperature difference between the intake air temperature Tair and the set temperature Tset is equal to or smaller than a reference temperature Th−Tc1 (Tair−Tset≤Th−Tc1) (Step S53). The above-mentioned value Tc1 is a first temperature correction value and is, for example, 0.5.

In Step S53, when the warm air supply turn-on condition is satisfied (Yes in Step S53), the controller 50 turns on the warm air supply (Step S54) and then determines whether a predetermined time period until the start of blow of the warm air (for example, five minutes or a time period until a refrigerant outlet temperature of the heat exchanger 4 becomes 35 degrees Celsius or higher) has elapsed (Step S55).

In Step S55, when the predetermined time period has elapsed (Yes in Step S55), the controller 50 sets the swing pattern to the swing pattern 2 with "downward 3" skipped once for two reciprocations and controls the blowing direction flaps 12 to swing in accordance with the swing pattern 2 (Step S56).

After Step S56, the controller 50 determines whether or not to change the swing pattern based on whether the temperature has increased to make the temperature difference between the intake air temperature Tair and the set temperature Tset larger than a reference temperature Th−Tc2 (Tair−Tset>Th−Tc2) (Step S57). The above-mentioned value Tc2 is the second temperature correction value and is, for example, 2.0.

In Step S57, when the condition of changing the swing pattern is satisfied (Yes in Step S57), the controller 50 sets the swing pattern to the swing pattern 3 with "downward 3" skipped twice for three reciprocations and controls the blowing direction flaps 12 to swing in accordance with the swing pattern 3 (Step S58).

After Step S58, the controller 50 determines whether or not to change the swing pattern based on whether the temperature has increased to make the temperature difference between the intake air temperature Tair and the set temperature Tset larger than a reference temperature Th−Tc3 (Tair−Tset>Th−Tc3) (Step S59). The above-mentioned value Tc3 is the third temperature correction value and is, for example, 1.0.

In Step S59, when the condition of changing the swing pattern is satisfied (Yes in Step S59), the controller 50 sets the swing pattern to the swing pattern 4 with "downward 3" skipped for all reciprocations and controls the blowing direction flaps 12 to swing in accordance with the swing pattern 4 (Step S60).

Meanwhile, when the condition of changing the swing pattern is not satisfied (No in Step S59), the controller 50 determines whether the temperature has decreased to make the temperature difference between the intake air temperature Tair and the set temperature Tset equal to or smaller than the reference temperature Th−Tc2 based on: Tair−Tset≤Th−Tc2 (Step S63).

In Step S63, when the temperature difference between the intake air temperature Tair and the set temperature Tset has been decreased to be equal to or smaller than the reference temperature Th−Tc2 (Yes in Step S63), the control performed by the controller 50 returns to Step S56.

Meanwhile, when the temperature difference between the intake air temperature Tair and the set temperature Tset has not been decreased to be equal to or smaller than the reference temperature Th−Tc2 (No in Step S63), the control performed by the controller 50 returns to Step S59.

After Step S60, the controller 50 determines whether or not to turn the warm air supply turn-off based on whether the temperature difference between the intake air temperature Tair and the set temperature Tset is higher than a reference temperature Th+Tc3 (Tair−Tset>Th+Tc3) (Step S61). In this case, the temperature condition of executing the warm air supply turn-off in Step S61 is set higher than the temperature condition of executing the warm air supply turn-off in the case in which the blowing direction is "horizontal" (see Step S23 of FIG. 7B). This is because the intake air temperature in the case in which the blowing direction is set to "swing" becomes higher than the intake air temperature in the case in which the blowing direction is "horizontal".

In Step S61, when the warm air supply turn-off condition is satisfied (Yes in Step S61), the controller 50 turns the warm air supply turn-off (Step S62). Then, the control returns to Step S52.

Meanwhile, when the warm air supply turn-off continuation condition is not satisfied (No in Step S61), the controller 50 determines whether the temperature difference between the intake air temperature Tair and the set temperature Tset has been decreased to be equal to or smaller than the reference temperature Th−Tc3 based on Tair−Tset≤Th−Tc3 (Step S64).

In Step S64, when the temperature difference between the intake air temperature Tair and the set temperature Tset has decreased to be equal to or smaller than the reference temperature Th−Tc3 (Yes in Step S64), the controller 50 determines whether the temperature has decreased to make the temperature difference between the intake air temperature Tair and the set temperature Tset equal to or smaller than the reference temperature Th−Tc2 based on: Tair−Tset≤Th−Tc2 (Step S65).

Meanwhile, when the temperature difference between the intake air temperature Tair and the set temperature Tset has not been decreased to be equal to or smaller than the reference temperature Th−Tc3 (No in Step S64), the control performed by the controller 50 returns to Step S61.

In Step S65, when the temperature difference between the intake air temperature Tair and the set temperature Tset has been decreased to be equal to or smaller than the reference temperature Th−Tc2 (Yes in Step S65), the control performed by the controller 50 returns to Step S56.

Meanwhile, when the temperature difference between the intake air temperature Tair and the set temperature Tset has not been decreased to be equal to or smaller than the reference temperature Th−Tc2 (No in Step S65), the control performed by the controller 50 returns to Step S59.

Figures 10, 11:
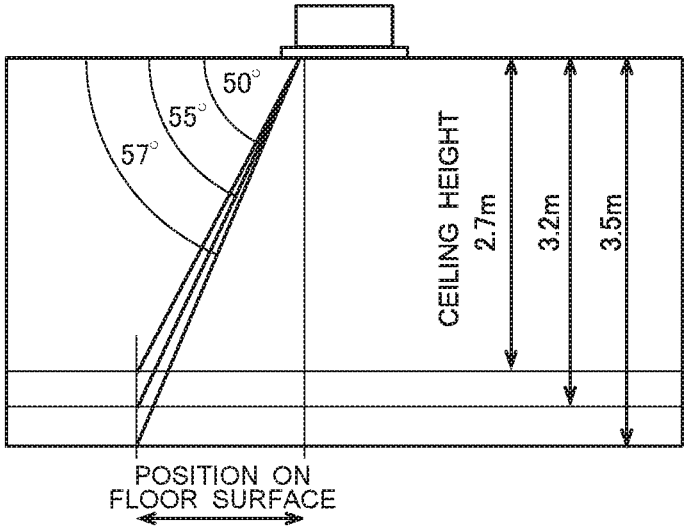
FIG. 10 is a table, with an illustration, for showing a ceiling height for and an angle of the blowing direction from the ceiling-concealed air-conditioning apparatus according to Embodiment 2 of the present invention.
FIG. 11 is a table for showing the ceiling height for and swing time of the ceiling-concealed air-conditioning apparatus according to Embodiment 2 of the present invention.

FIG. 10 is a table, with an illustration, for showing a ceiling height for and an angle of the blowing direction from the air-conditioning apparatus 100A according to Embodiment 2 of the present invention.

From the ceiling-concealed air-conditioning apparatus 100A to be installed to the ceiling, an air-conditioning target space in which a person is present is far depending on the ceiling height at which the ceiling-concealed air-conditioning apparatus 100A is installed. Therefore, a blowing speed from the air outlet 8 is changed in accordance with the ceiling height. As illustrated in FIG. 10, a horizontal position at which the air reaches the floor surface 21 differs depending on the ceiling height. Therefore, the angle of the blowing direction is also changed in accordance with the ceiling height so that an air-conditioning target range is not changed depending on the ceiling height and a predetermined range can be air-conditioned.

FIG. 11 is a table for showing the ceiling height for and swing time of the ceiling-concealed air-conditioning apparatus 100A according to Embodiment 2 of the present invention. The "swing time" herein corresponds to time required to complete a one-way operation for swinging the blowing direction flaps 12 from the horizontal direction to the perpendicular direction, specifically, for changing the blowing direction from "horizontal" to "downward 3" when the blowing direction is set to "swing", and the swing time is the same for an operation in a reverse direction.

Further, when the blowing direction is set to "swing" in a case in which the ceiling is higher than a standard, a delay is generated for the air to reach the floor surface 21 and in change in temperature. As a result, comfortability may be impaired or heating may become insufficient in some cases. Therefore, as illustrated in FIG. 11, a speed of swinging the blowing direction flaps 12 (hereinafter also referred to as "swing speed") is also changed in accordance with the ceiling height. As the height of the ceiling increases, the swing speed is decreased. In this manner, after the air reaches sufficiently, the blowing direction is changed to a subsequent blowing direction.

Based on the fact described above, in the ceiling-concealed air-conditioning apparatus 100A according to Embodiment 2, the controller 50 has the function of swinging the blowing direction flaps 12. The function has the plurality of swing patterns. During the heating operation, the swing pattern is changed in accordance with the temperature difference between the intake air temperature and the preset setting temperature.

In this manner, even when the air outlet 8 is formed on the outer side of the air inlet 7 and the intake air temperature increases during the downward blow, the indoor air temperature of the whole room can be increased.

Further, in the ceiling-concealed air-conditioning apparatus 100A according to Embodiment 2, when the temperature difference between the intake air temperature and the set temperature is larger than the reference temperature during the heating operation, the controller 50 changes the swing pattern with the reduced number of times to cause the blowing direction flaps 12 to assume the orientation closest to the perpendicular direction relative to the ceiling surface 20.

As described above, the heating operation is performed while the swing pattern is changed to the swing pattern with the reduced number of times to cause the blowing direction flaps 12 to assume the orientation closest to the perpendicular direction relative to the ceiling surface 20. As a result, the operation has high efficiency and is effective in increasing the indoor air temperature of the whole room.

Further, when the ceiling-concealed air-conditioning apparatus 100A according to Embodiment 2 has the plurality of blowing direction settings for orientating the blowing direction flaps 12 in the perpendicular direction relative to the ceiling surface 20 at the different angles. When the ceiling-concealed air-conditioning apparatus 100A is to be installed to a first ceiling and a second ceiling higher than the first ceiling and even when the same blowing direction is set during the heating operation, the controller 50 controls the orientation of the blowing direction flaps 12 so that the blowing direction flaps 12 in the case of the installation in the second ceiling become closer to the perpendicular direction relative to the ceiling surface 20 than in the case of the installation in the first ceiling.

In this manner, the ceiling-concealed air-conditioning apparatus 100A, which is configured to condition the air over the same range as the range over which the air is conditioned in a case in which the ceiling height is the standard height even when the ceiling height is high, can be obtained.

When the ceiling-concealed air-conditioning apparatus 100A according to Embodiment 2 is to be installed to the first ceiling and the second ceiling higher than the first ceiling, the controller 50 decreases the speed of swinging the blowing direction flaps 12 so that the swinging speed becomes slower in the case of the installation in the second ceiling than the swinging speed in the case of the installation in the first ceiling even with the same swing pattern setting.

In this manner, the ceiling-concealed air-conditioning apparatus 100A, which enables the air to reach the floor surface 21 even when the ceiling height is high, can be obtained.

The ceiling height may be automatically detected by providing, for example, a distance detecting unit such as an infrared sensor to the ceiling-concealed air-conditioning apparatus 100A or may be set by the user when the ceiling-concealed air-conditioning apparatus 100A is installed to the ceiling.

REFERENCE SIGNS LIST

1 casing 1*a* outer shell 1*b* heat insulating material 2 fan 3 motor 4 heat exchanger 5 drain pan 6 panel 7 air inlet 8 air outlet 9 filter 10 maintenance panel 11 temperature detector 12 blowing direction flap 20 ceiling surface 21 floor surface 22 wall surface 50 controller 51 storage unit 52 determination unit 53 communication unit 54 blowing direction control unit 100 ceiling-concealed air-conditioning apparatus 100A ceiling-concealed air-conditioning apparatus

The invention claimed is:

1. An air-conditioning apparatus, comprising:

a casing having an opening;

a panel, which is provided to the opening and has an air inlet and an air outlet formed on an outer side of the air inlet;

a blowing direction flap, which is configured to change a blowing direction of an air blown from the air outlet;

a temperature detector, which is configured to detect an intake air temperature of air sucked from the air inlet; and a controller, which is configured to control the blowing direction flap, wherein, during a heating operation, the controller is configured to turn off warm air supply based on the intake air temperature and an orientation of the blowing direction flap, and when the blowing direction flap is oriented in a perpendicular direction relative to a ceiling surface, the controller turns off warm air supply when the intake temperature is relatively high in comparison to the intake temperature at which the controller turns off warm air supply when the blowing direction flap is oriented in a horizontal direction relative to the ceiling surface.

2. The air-conditioning apparatus of claim 1, wherein the controller is configured to, during the heating operation, change the orientation of the blowing direction flap in accordance with a temperature difference between the intake air temperature and a preset setting temperature.

3. The air-conditioning apparatus of claim 2, wherein the controller is configured to, during the heating operation, change the orientation of the blowing direction flap from the perpendicular direction to the horizontal direction relative to the ceiling surface when the temperature difference between the intake air temperature and the set temperature is equal to or smaller than a reference temperature, and changes the orientation of the blowing direction flap from the horizontal direction to the perpendicular direction relative to the ceiling surface when the temperature difference between the intake air temperature and the set temperature is larger than the reference temperature.

4. The air-conditioning apparatus of claim 1, wherein the controller is configured to swing the blowing direction flap by a plurality of swing patterns, and wherein, during the heating operation, a current swing pattern of the plurality of swing patterns is changed in accordance with a temperature difference between the intake air temperature and a preset setting temperature.

5. The air-conditioning apparatus of claim 4, wherein, the controller is configured to, during the heating operation, when the temperature difference between the intake air temperature and the set temperature is larger than a reference temperature, change the current swing pattern to a swing pattern among the plurality of swing patterns that has fewer occurrences of the blowing direction flap assuming an orientation closest to the perpendicular direction relative to the ceiling surface.

6. The air-conditioning apparatus of claim 1, wherein the controller has a plurality of blowing direction settings to cause the blowing direction flap to assume orientations at different angles from the perpendicular direction relative to the ceiling surface, and wherein the air-conditioning apparatus is installed in one of a first ceiling and a second ceiling, and the second ceiling is higher than the first ceiling, and the controller is configured to control the orientation of the blowing direction flap, during the heating operation, so that the blowing direction flap is oriented closer to the perpendicular direction relative to the ceiling surface in a case where the air-conditioning apparatus is installed in the second ceiling in comparison to a case where the air-conditioning apparatus is installed in the first ceiling.

7. The air-conditioning apparatus of claim 4, wherein the air-conditioning apparatus is installed in one of a first ceiling and a second ceiling, and the second ceiling is higher than the first ceiling, and the controller is configured to, even when the blowing direction flap is controlled to swing in a single swing pattern, decrease a speed of swinging the blowing direction flap so that the speed of swinging the air flow direction flap in a case where the air-conditioning apparatus is installed in the second ceiling becomes lower than the speed of swinging the blowing direction flap in a case where the air-conditioning apparatus is installed in the first ceiling.

8. The air-conditioning apparatus of claim 2, wherein the controller has a plurality of blowing direction settings to cause the blowing direction flap to assume orientations at different angles from the perpendicular direction relative to the ceiling surface, and wherein the air-conditioning apparatus is installed in one of a first ceiling and a second ceiling, and the second ceiling is higher than the first ceiling, and the controller is configured to control the orientation of the blowing direction flap, during the heating operation, so that the blowing direction flap is oriented closer to the perpendicular direction relative to the ceiling surface in a case where the air-conditioning apparatus is installed in the second ceiling in comparison to a case where the air-conditioning apparatus is installed in the first ceiling.

9. The air-conditioning apparatus of claim 3, wherein the controller has a plurality of blowing direction settings to cause the blowing direction flap to assume orientations at different angles from the perpendicular direction relative to the ceiling surface, and wherein the air-conditioning apparatus is installed in one of a first ceiling and a second ceiling, and the second ceiling is higher than the first ceiling, and the controller is configured to control the orientation of the blowing direction flap, during the heating operation, so that the blowing direction flap is oriented closer to the perpendicular direction relative to the ceiling surface in a case where the air-conditioning apparatus is installed in the second ceiling in comparison to a case where the air-conditioning apparatus is installed in the first ceiling.

10. The air-conditioning apparatus of claim 4, wherein the controller has a plurality of blowing direction settings to cause the blowing direction flap to assume orientations at different angles from the perpendicular direction relative to the ceiling surface, and wherein the air-conditioning apparatus is installed in one of a first ceiling and a second ceiling, and the second ceiling is higher than the first ceiling, and the controller is configured to control the orientation of the blowing direction flap, during the heating operation, so that the blowing direction flap is oriented closer to the perpendicular direction relative to the ceiling surface in a case where the air-conditioning apparatus is installed in the second ceiling in comparison to a case where the air-conditioning apparatus is installed in the first ceiling.

11. The air-conditioning apparatus of claim 5, wherein the controller has a plurality of blowing direction settings to cause the blowing direction flap to assume orientations at different angles from the perpendicular direction relative to the ceiling surface, and wherein the air-conditioning apparatus is installed in one of a first ceiling and a second ceiling, and the second ceiling is higher than the first ceiling, and the controller is configured to control the orientation of the blowing direction flap, during the heating operation, so that the blowing direction flap is oriented closer to the perpendicular direction relative to the ceiling surface in a case where the air-conditioning apparatus is installed in the second ceiling in comparison to a case where the air-conditioning apparatus is installed in the first ceiling.

12. The air-conditioning apparatus of claim 5, wherein the air-conditioning apparatus is installed in one of a first ceiling and a second ceiling, and the second ceiling is higher than the first ceiling, and the controller is configured to, even when the blowing direction flap is controlled to swing in a single swing pattern, decrease a speed of swinging the blowing direction flap so that the speed of swinging the air flow direction flap in a case where the air-conditioning apparatus is installed in the second ceiling becomes lower than the speed of swinging the blowing direction flap in a case where the air-conditioning apparatus is installed in the first ceiling.

13. The air-conditioning apparatus of claim 6, wherein the air-conditioning apparatus is installed in one of a first ceiling and a second ceiling, and the second ceiling is higher than the first ceiling, and the controller is configured to, even when the blowing direction flap is controlled to swing in a single swing pattern, decrease a speed of swinging the blowing direction flap so that the speed of swinging the air flow direction flap in a case where the air-conditioning apparatus is installed in the second ceiling becomes lower than the speed of swinging the blowing direction flap in a case where the air-conditioning apparatus is installed in the first ceiling.

14. The air-conditioning apparatus of claim 8, wherein the air-conditioning apparatus is installed in one of a first ceiling and a second ceiling, and the second ceiling is higher than the first ceiling, and the controller is configured to, even when the blowing direction flap is controlled to swing in a single swing pattern, decrease a speed of swinging the blowing direction flap so that the speed of swinging the air flow direction flap in a case where the air-conditioning apparatus is installed in the second ceiling becomes lower than the speed of swinging the blowing direction flap in a case where the air-conditioning apparatus is installed in the first ceiling.

15. The air-conditioning apparatus of claim 9, wherein the air-conditioning apparatus is installed in one of a first ceiling and a second ceiling, and the second ceiling is higher than the first ceiling, and the controller is configured to, even when the blowing direction flap is controlled to swing in a single swing pattern, decrease a speed of swinging the blowing direction flap so that the speed of swinging the air flow direction flap in a case where the air-conditioning apparatus is installed in the second ceiling becomes lower than the speed of swinging the blowing direction flap in a case where the air-conditioning apparatus is installed in the first ceiling.

16. The air-conditioning apparatus of claim 10, wherein the air-conditioning apparatus is installed in one of a first ceiling and a second ceiling, and the second ceiling is higher than the first ceiling, and the controller is configured to, even when the blowing direction flap is controlled to swing in a single swing pattern, decrease a speed of swinging the blowing direction flap so that the speed of swinging the air flow direction flap in a case where the air-conditioning apparatus is installed in the second ceiling becomes lower than the speed of swinging the blowing direction flap in a case where the air-conditioning apparatus is installed in the first ceiling.

17. The air-conditioning apparatus of claim 11, wherein the air-conditioning apparatus is installed in one of a first ceiling and a second ceiling, and the second ceiling is higher than the first ceiling, and the controller is configured to, even when the blowing direction flap is controlled to swing in a single swing pattern, decrease a speed of swinging the blowing direction flap so that the speed of swinging the air flow direction flap in a case where the air-conditioning apparatus is installed in the second ceiling becomes lower than the speed of swinging the blowing direction flap in a case where the air-conditioning apparatus is installed in the first ceiling.

* * * * *